US008944155B2

(12) United States Patent
Martin

(10) Patent No.: US 8,944,155 B2
(45) Date of Patent: Feb. 3, 2015

(54) ANNULAR AXIAL FLOW RIBBED HEAT EXCHANGER

(75) Inventor: Michael Andrew Martin, Hamilton, CA (US)

(73) Assignee: Dana Canada Corporation, Oakville, Ontario (CA)

( * ) Notice: Subject to any disclaimer, the term of this patent is extended or adjusted under 35 U.S.C. 154(b) by 1003 days.

(21) Appl. No.: 12/836,935

(22) Filed: Jul. 15, 2010

(65) Prior Publication Data

US 2012/0012289 A1 Jan. 19, 2012

(51) Int. Cl.

| | |
|---|---|
| ***F28F 3/12*** | (2006.01) |
| ***F28F 3/14*** | (2006.01) |
| ***F24H 3/00*** | (2006.01) |
| ***F28D 7/10*** | (2006.01) |
| ***F02G 1/055*** | (2006.01) |
| ***F28F 1/42*** | (2006.01) |
| *F28D 21/00* | (2006.01) |

(52) U.S. Cl.

CPC ..... *F28D 7/103* (2013.01); *F02G 1/055* (2013.01); *F28F 1/426* (2013.01); *F02G 2256/00* (2013.01); *F28D 2021/0026* (2013.01)

USPC ..... 165/169; 165/46; 165/168; 165/170

(58) Field of Classification Search

CPC ..... F28F 3/12; F28F 3/14; F28D 7/106

USPC ..... 165/109.1, 154, 164, 166, 157, 169, 165/167

See application file for complete search history.

(56) References Cited

U.S. PATENT DOCUMENTS

| | | | |
|---|---|---|---|
| 744,111 | A | 11/1903 | Roderwald |
| 3,015,475 | A | 1/1962 | Meijer et al. |
| 2,707,096 | A | 4/1965 | Koopmans |
| 3,335,789 | A | 8/1967 | Raskin |

(Continued)

FOREIGN PATENT DOCUMENTS

| | | | |
|---|---|---|---|
| EP | 0273073 | A1 | 7/1988 |
| WO | WO03072921 | A | 9/2003 |

(Continued)

OTHER PUBLICATIONS

Machine translation of WO2009/053496.*

(Continued)

*Primary Examiner* — Allana Lewin
*Assistant Examiner* — Dawit Muluneh
(74) *Attorney, Agent, or Firm* — Marshall & Melhorn, LLC

(57) ABSTRACT

A cylindrical, annular axial flow heat exchanger for use as a gas cooler in a thermal regenerative machine such as a Stirling engine is provided. The heat exchanger includes an outer shell of sufficient strength and thickness to withstand the pressure exerted by the working fluid and a tubular member positioned adjacent to and in contact with the outer shell, the tubular member having spaced apart sidewalls defining a flow passage therebetween. At least one of the sidewalls of the tubular member is embossed with ribs, the ribs being in contact with the inner surface of the outer shell thereby defining axially extending flow passages between the outer shell and tubular member along the circumference thereof for the flow of a second, gaseous fluid through the heat exchanger. The first fluid flows circumferentially through tubular member, while the second fluid flows axially between the outer shell and the tubular member.

21 Claims, 7 Drawing Sheets

(56) References Cited

U.S. PATENT DOCUMENTS

| | | | | | |
|---|---|---|---|---|---|
| 3,991,822 | A | * | 11/1976 | Morris | 165/140 |
| 4,096,616 | A | * | 6/1978 | Coffinberry | 29/890.036 |
| 4,228,848 | A | | 10/1980 | Wadkinson | |
| 4,448,243 | A | | 5/1984 | Pain | |
| 4,592,415 | A | | 6/1986 | Friedman | |
| 4,945,981 | A | | 8/1990 | Joshi | |
| 5,487,424 | A | * | 1/1996 | Davison | 165/166 |
| 5,538,075 | A | | 7/1996 | Eubank et al. | |
| 5,743,091 | A | | 4/1998 | Penswick et al. | |
| 5,797,449 | A | * | 8/1998 | Oswald et al. | 165/165 |
| RE35,890 | E | | 9/1998 | So | |
| 5,918,463 | A | | 7/1999 | Penswick et al. | |
| 6,012,514 | A | | 1/2000 | Swain | |
| 6,019,168 | A | | 2/2000 | Kinnersly | |
| 6,050,092 | A | | 4/2000 | Genstler et al. | |
| 6,273,183 | B1 | | 8/2001 | So et al. | |
| 6,585,034 | B2 | * | 7/2003 | Oswald | 165/10 |
| 6,701,721 | B1 | * | 3/2004 | Berchowitz | 62/6 |
| 7,007,749 | B2 | | 3/2006 | Brost et al. | |
| 7,191,824 | B2 | | 3/2007 | Wu et al. | |
| 2001/0045275 | A1 | | 11/2001 | Banno et al. | |
| 2003/0131978 | A1 | * | 7/2003 | Nakano | 165/164 |
| 2003/0131979 | A1 | * | 7/2003 | Kim | 165/164 |
| 2005/0155748 | A1 | | 7/2005 | Seager | |
| 2008/0236800 | A1 | * | 10/2008 | Wang et al. | 165/138 |
| 2010/0181052 | A1 | | 7/2010 | Burgers et al. | |

FOREIGN PATENT DOCUMENTS

| | | | |
|---|---|---|---|
| WO | WO2005043059 A2 | | 5/2005 |
| WO | WO2009/053496 | * | 4/2009 |

OTHER PUBLICATIONS

PCT International Search Report, regarding application No. PCT/CA2010/000064 dated Apr. 21, 2010.

* cited by examiner

ANNULAR AXIAL FLOW RIBBED HEAT EXCHANGER

TECHNICAL FIELD

The invention relates to heat exchangers, and in particular, to cylindrical, gas-to-liquid heat exchangers suitable for use in Stirling engines and in other applications.

BACKGROUND

In a Stirling engine cycle heat energy is converted into mechanical power by alternately compressing and expanding a fixed quantity of a gas or working fluid at different temperatures. More specifically, in a Stirling cycle electric power generator, a movable displacer moves reciprocally within the generator housing, transferring a pressurized working fluid, such as helium, back and forth between a low temperature contraction space and a high temperature expansion space. A gas cooler is provided adjacent to the pressure wall of the compression space to extract heat from the working fluid as it flows into the compression space. In conventional constructions the gas cooler may be in the form of an annular bundle of thin-walled tubes, the construction of which requires a large number of brazed connections. The large numbers of brazed joints, coupled with high internal working gas pressures, can lead to an increased likelihood of failure in this type of heat exchanger. Heat transfer is also limited in the tube bundle structure.

BRIEF SUMMARY OF THE INVENTION

A heat exchanger has an outer shell, a tubular member and inlet and outlet openings. The outer shell has an outer surface and an inner surface. The outer shell defines a generally cylindrical, axially extending tubular form with an open, interior space. The tubular member is positioned adjacent to and in contact with the inner surface of the outer shell. The tubular member has a generally cylindrical, axially extending tubular form that follows the inner circumference of the outer shell. The tubular member has spaced apart first and second sidewalls defining a first flow passage therebetween for the flow of a first fluid through the heat exchanger. The inlet and outlet openings extend through the outer shell and the first sidewall of the tubular member and are in fluid communication with the first flow passage. The inlet and outlet openings are circumferentially spaced apart from one another so that fluid entering through the inlet opening flows the maximum circumferential length of the tubular member before exiting through the outlet opening. At least the first sidewall of the tubular member is embossed so as to form a first set of generally axially extending spaces between the first sidewall of the tubular member and the inner surface of the outer shell. The spaces provide a second flow passage between the outer shell and tubular member for the flow of a second fluid through the heat exchanger.

BRIEF DESCRIPTION OF THE DRAWINGS

Embodiments of the present disclosure will now be described, by way of example only, with reference to the attached Figures, wherein.

Like reference numerals are used in the drawings to denote like elements and features.

DETAILED DESCRIPTION OF THE EXAMPLE EMBODIMENTS

In the following description, the heat exchangers described are specifically adapted for use as gas cooling heat exchangers in thermal regenerative machines such as Stirling engines. It will, however, be appreciated that heat exchangers of the type described below are not restricted for use in Stirling engines, but rather may be used as gas-to-liquid heat exchangers in various other applications.

In accordance with one example embodiment of the present disclosure there is provided a heat exchanger, comprising: an outer shell having an outer surface and an inner surface, the outer shell defining a generally cylindrical, axially extending tubular form with an open, interior space; a tubular member positioned adjacent to and in contact with the inner surface of the outer shell, the tubular member having a generally cylindrical, axially extending tubular form that follows the circumference of the inner surface of the outer shell, the tubular member having spaced apart first and second sidewalls defining a first flow passage therebetween for the flow of a first fluid through the heat exchanger; inlet and outlet openings extending through the outer shell and the first sidewall of the tubular member and in fluid communication with the first flow passage, wherein the inlet and outlet openings are circumferentially spaced apart from one another so that fluid entering through the inlet opening flows the entire circumferential length of the first flow passage before exiting through the outlet opening; and wherein at least the first sidewall of the tubular member is embossed so as to form generally axially extending spaces between the first sidewall of the tubular member and the inner surface of the outer shell, the spaces providing a second flow passage between the outer shell and tubular member for the flow of a second fluid through the heat exchanger.

Figure 1:
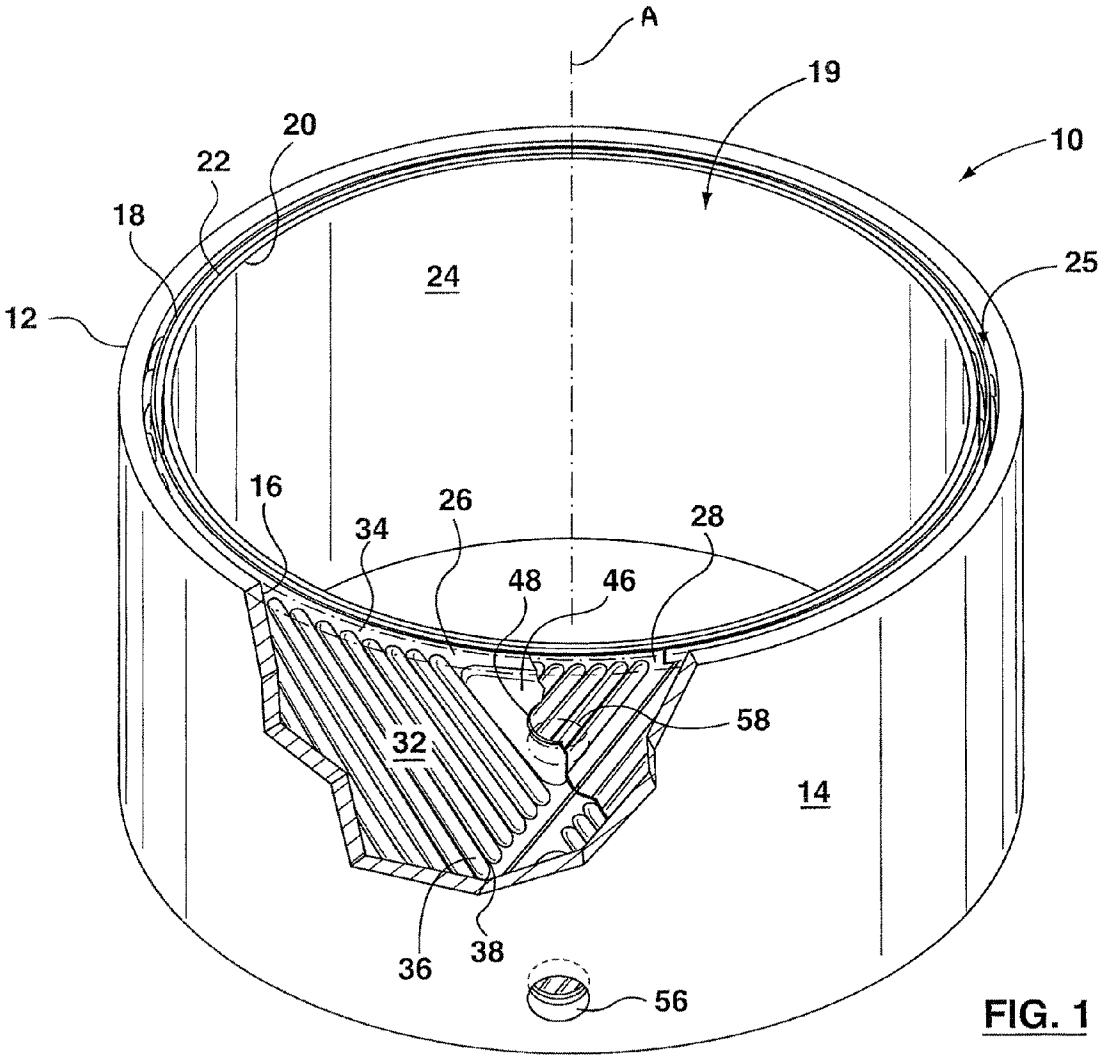
FIG. 1 is a partly cut-away perspective view of a heat exchanger according to an example embodiment of the present disclosure.
Figure 2:
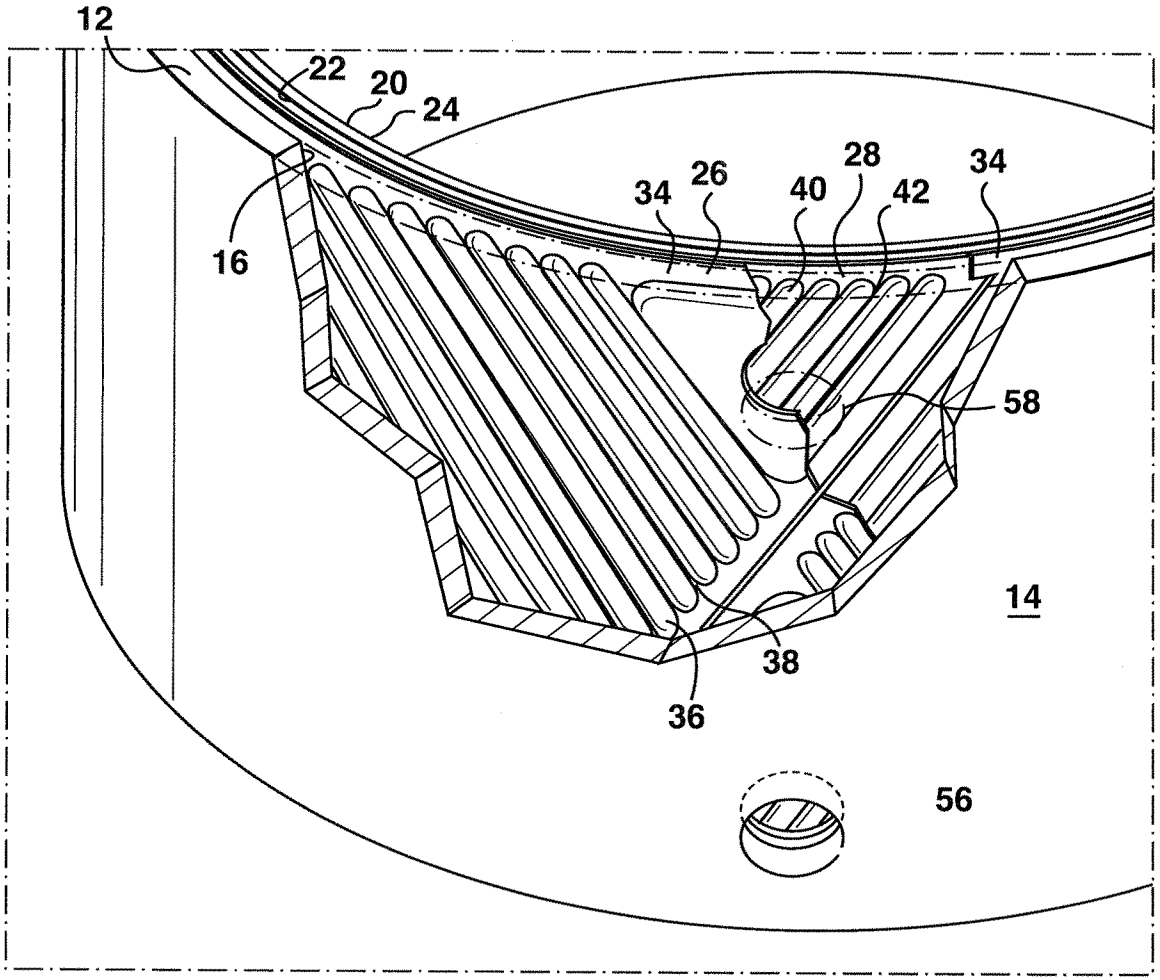
FIG. 2 is a detail view of the cut-away portion of the heat exchanger shown in FIG. 1.

Referring to the drawings, there is shown in FIG. 1 a heat exchanger 10 according to one example embodiment of the present disclosure. As illustrated, heat exchanger 10 is generally in the shape of an open-ended, hollow cylinder having a longitudinal axis A passing centrally through the hollow interior space of the heat exchanger 10. In the following description, the terms such as "axial" and the like refer to directions which are parallel to the axis A, and terms such as "inner", "outer" and the like refer to radial directions extending outwardly from or inwardly toward axis A, and which are transverse to axis A.

Heat exchanger 10 comprises a generally cylindrical, axially extending outer shell 12 having an outer surface 14 and an inner surface 16. A tubular member 18 positioned radially inwardly with respect to the outer shell 12, with portions of the tubular member 18 being in direct contact with the inner surface 16 of the outer shell 12. Tubular member 18 is also cylindrical in shape and axially extends so as to follow the circumference of the inner surface 16 of the outer shell 12. The tubular member 18 is formed with spaced-apart first and second sidewalls which define a first flow passage therebetween. In the embodiment shown, heat exchanger 10 also includes a generally cylindrical, axially extending inner shell 20 positioned radially inwardly with respect to tubular member 18, the inner shell 20 having an outer surface 22 and an inner surface 24. It will be understood, however, that the inner shell 20 is not necessarily required in the construction of the heat exchanger 10, as will be described below in connection with alternate embodiments of the heat exchanger 10. In embodiments where an inner shell 20 is provided, however, the inner shell 20 is placed in close proximity to tubular member 18 such that portions of the tubular member 18 are also in direct contact with the outer surface 22 of the inner shell 20. Therefore, in essence, the outer shell 12 and the inner shell 20 together provide an axially extending annular space 25 between them for receiving tubular member 18 while leaving an open or hollow centre 19 of the heat exchanger 10.

In accordance with one example embodiment of the heat exchanger 10, tubular member 18 is comprised of first and second mating, generally elongate plates 26, 28 formed with corresponding angled ends 30, the first and second plates 26, 28 defining the first and second spaced-apart sidewalls and first flow passage through the tubular member 18. First and second plates 26 and 28 are similar in structure to each other in that they each have a sidewall or central portion 32 surrounded by a peripheral flange 34 for sealingly joining to the corresponding peripheral flange 34 provided on the mating first or second plate 26, 28. The central portion 32 of the first plate 26 is embossed or formed with a series of outwardly protruding ribs 36 oriented in a first direction, the ribs 36 being spaced apart from each other along the length of the plate 26 by trough regions 38. In this example embodiment, the central portion 32 of the second plate 28 is also formed with protruding ribs 40 that are oriented in a second direction, opposite to the first direction, along the length of the second plate 28, the ribs 40 also being spaced apart from each other along the length of the second plate 28 by trough regions 42. As the second plate 28 is positioned directly opposite to the first plate 26 in facing relation to each other, it will be understood that the ribs 36 on the first plate 26 protrude in a direction away from axis A (i.e. "outwardly" with respect to axis A) while the ribs 40 on the second plate 28 protrude in a direction toward axis A (i.e. "inwardly" with respect to axis A) of the heat exchanger 10. When the first and second plates 26, 28 are placed together in facing relation to form tubular member 18, portions of the trough regions 38 on the first plate 26 contact and form a seal with corresponding portions of the trough regions 42 on the second plate 28 while corresponding portions of the ribs 36, 40 on the first and second plates 26, 28 remain spaced apart from each other. The criss-crossing of the oppositely disposed ribs 36, 40 and trough regions 38, 42 in the first and second plates 26, 28 creates a tortuous or turbulent flow path through the first fluid passageway formed in tubular member 18. The turbulent flow path helps to increase the heat transfer properties of the fluid flowing through the tubular member 18.

Figure 4:
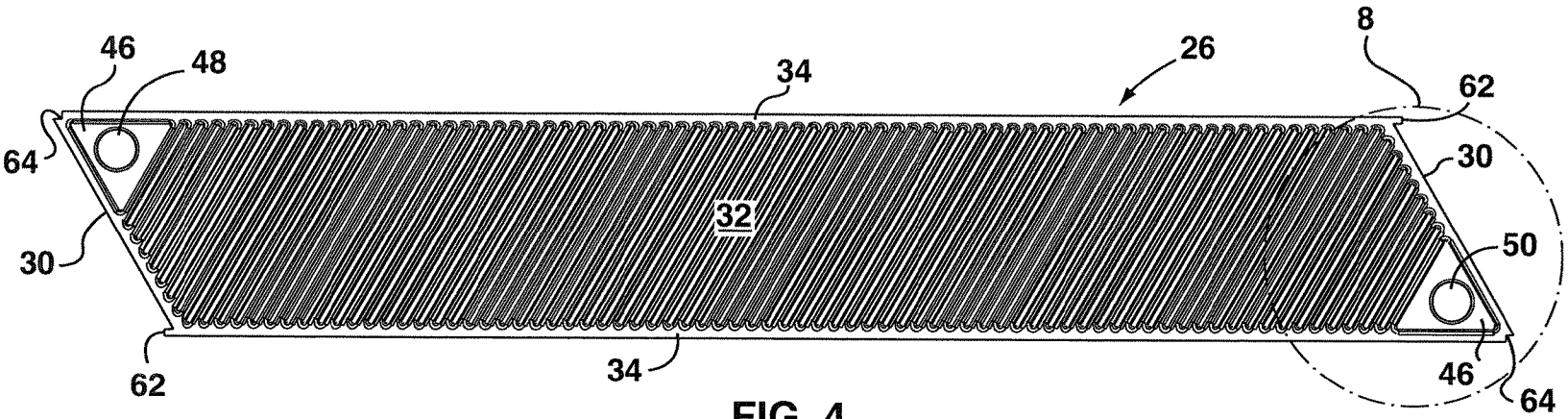
FIG. 4 is an elevation view of the first plate used to form the tubular member shown in FIG. 3, the first plate being in its planar state as viewed from its inner surface.
Figure 5:
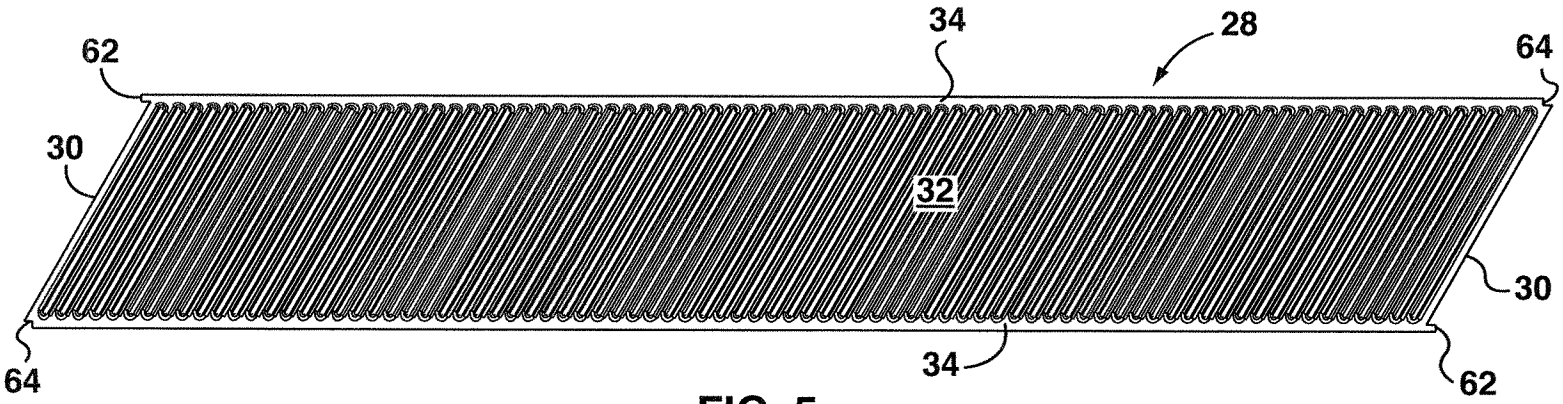
FIG. 5 is an elevation view of the second plate used to form the tubular member shown in FIG. 3, the second plate being in its planar state as viewed from its outer surface.
Figure 6:
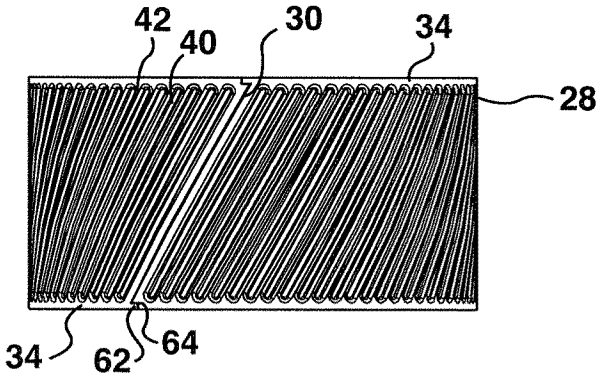
FIG. 6 is a front elevation view of the second plate shown in FIG. 5 in its cylindrical form.
Figure 8:
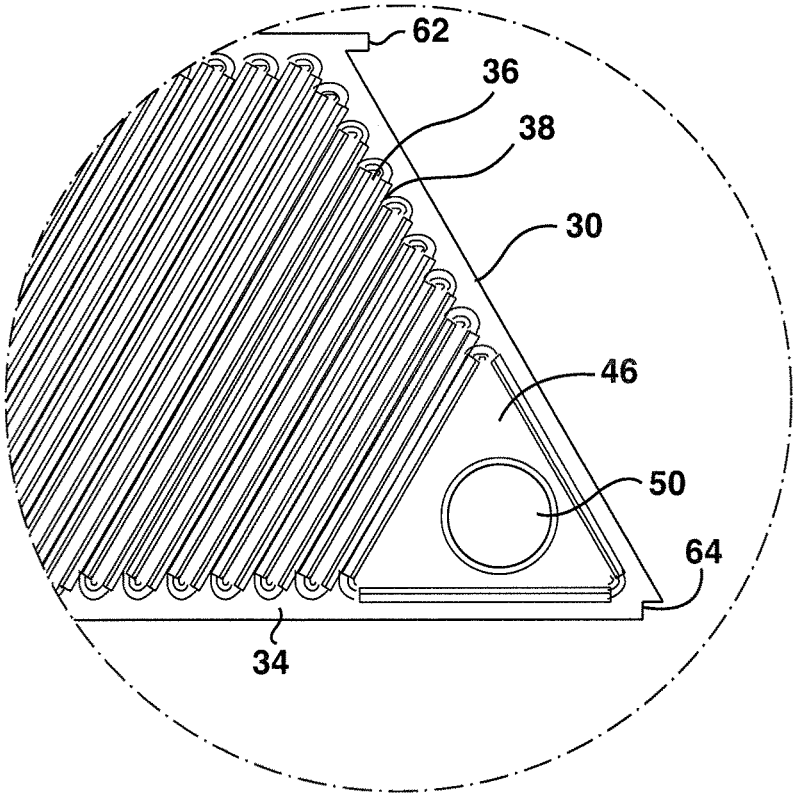
FIG. 8 is a detail view of an end portion of the first plate shown in FIG. 4.

Referring now to FIGS. 4 and 5, elevation views of the first and second plates 26, 28 used to form the tubular member 18 are illustrated. As shown in FIG. 4 and as described above, first plate 26 has central portion 32 formed with diagonally oriented ribs 36 that are spaced apart from each other along the length of the plate 26 by trough regions 38. The first plate 26 is surrounded by peripheral flange 34 for mating with the corresponding peripheral flange 34 of second plate 28. The first plate 26 also has embossments or bosses 46 formed in the opposed outermost corners of the angled ends 30 of the plate 26. Each boss 46 is formed with a respective inlet or outlet opening 48, 50 for providing an inlet and outlet for the flow of a first fluid through tubular member 18 when the first and second plates 26, 28 are placed in their mating, facing relationship. As shown in FIG. 5, second plate 28 is of similar construction as first plate 26 except that the entire central portion 32 of the second plate 28 is formed with protruding ribs 40, spaced apart by trough regions 42, as the second plate 28 is not formed with bosses. In this example embodiment, the corresponding angled ends 30 of the first and second plates 26, 28 are formed with interlocking elements to ensure proper alignment and mating of the ends 30 of the first and second plates 26, 28 when they are bent into their cylindrical form to form tubular member 18. More specifically, the corresponding corners of each of the first and second plates 26, 28 are formed with corresponding male and female interlocking elements 62, 64. For instance, as seen in FIG. 4, the top right and bottom left corners of the first plate 26 are formed with a recess or a female interlocking element 64, while the top left and bottom right corners are formed with tabs or male interlocking elements 62. A similar arrangement is provided on second plate 28, as shown in FIG. 5.

Figure 3:
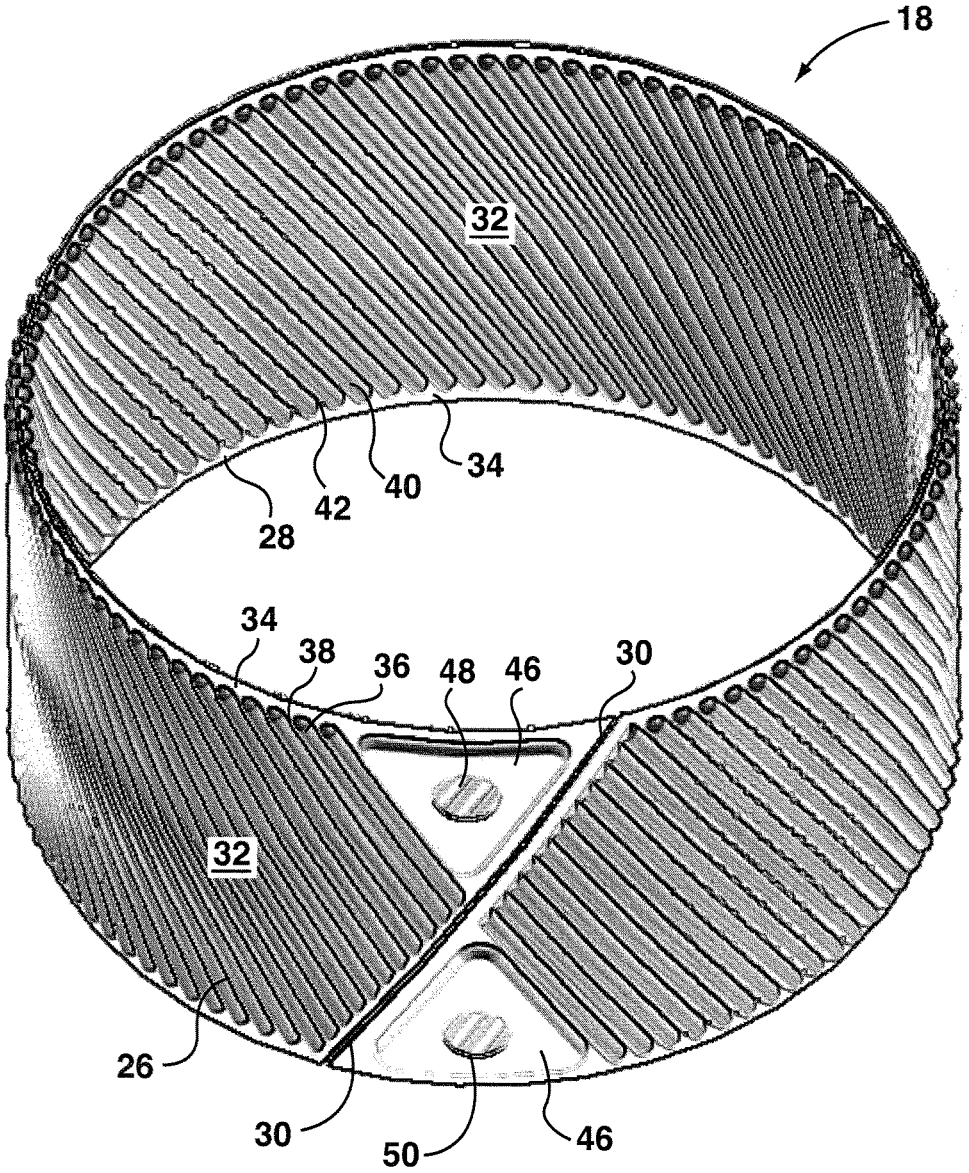
FIG. 3 is a perspective view of a tubular member used to form the heat exchanger shown in FIG. 1.
Figure 7:
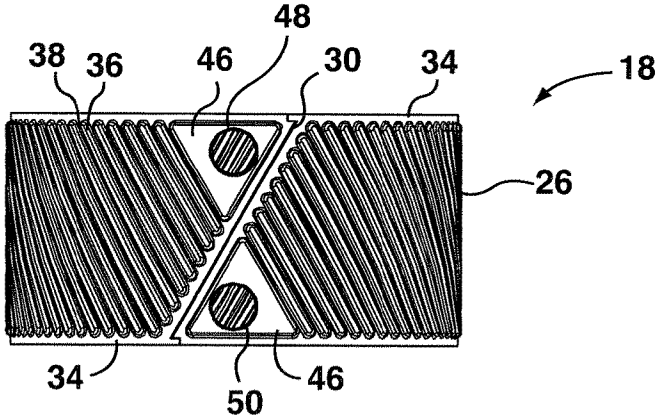
FIG. 7 is a front elevation view of the tubular member formed by the first and second plates shown in FIGS. 4 and 5, in its cylindrical form.

To form tubular member 18, the first and second plates 26, 28 are placed in their mating, facing relation and bent into a cylindrical form (see FIG. 7), with the corresponding angled ends 30 of the first and second plates 26, 28 substantially abutting each other, as best seen in FIGS. 3 and 7. As the angled ends 30 of the first and second plates 26, 28 are brought together, the corresponding male and female interlocking elements 62, 64 on the respective ends of the first and second plates 26, 28 engage so as to ensure proper alignment of the ends 30 of the tubular member 18. While the interlocking elements 62, 64 are shown in the form of corresponding tabs and recesses, it will be understood that any suitable interlocking feature may be used. As well, it will be understood that first and second plates 26, 28 may be formed without any aligning means or interlocking elements.

To form heat exchanger 10, tubular member 18 is positioned adjacent to and in mating relationship with the outer shell 12. As discussed above, outer shell 12 is generally cylindrical having an outer surface 14 and an inner surface 16. The outer shell 12 is formed with inlet and outlet openings 56, 58 which correspond to and are in fluid communication with the inlet and outlet openings 48, 50 provided in tubular member 18. Appropriate inlet and outlet fittings (not shown) are mounted in communication with inlet and outlet openings 56, 58 for the flow of a first fluid (i.e. a liquid coolant) through the heat exchanger 10.

As a result of the close proximity of the tubular member 18 to outer shell 12, the bosses 46 surrounding inlet and outlet openings 48, 50 of the tubular member 18 contact and provide a sealing surface against the inner surface 16 of the outer shell 12. As well, ribs 36 formed on the first plate 26 contact the inner surface 16 of the outer shell 12 thereby providing a multiplicity of contact points or brazing surfaces therebetween. The contact between the tubular member 18 and the outer shell 12 ensures a strong connection between the tubular member 18 and the outer shell 12 when the components of the heat exchanger 10 are joined together, for example, by brazing. The contact between the ribs 36 and the inner surface 16 of the outer shell 12 also results in a plurality of axially extending passageways being formed between the inner surface 16 of the outer shell 12 and the inwardly disposed trough regions 38 on the first plate 26 for the flow of a second fluid (i.e. a gas) through the heat exchanger 10. In the embodiments where an inner shell 20 is provided, the inner shell 20 is placed adjacent to and in close proximity to the second plate 28 of tubular member 18. Accordingly, the ribs 40 formed in the second plate 28 of the tubular member 18 contact the outer surface 22 of the inner shell 20 providing additional contact points or brazing surfaces therebetween. As a result of the close proximity and contact between the tubular member 18 and the inner shell 20, a second set of axially extending fluid passageways are formed between the trough regions 42 on the second plate 28 and the outer surface 22 of the inner shell 20, which axially extending passageways are also for the flow of the second fluid through heat exchanger 10. Therefore, when an inner shell 20 is provided, the second fluid flowing through the heat exchanger 10 is split between the axially extending passageways on either side of the tubular member 18. As a result of the angled or diagonal orientations of the ribs 36, 40 and trough regions 38, 42 in their respective first and second directions, the axially extending passageways formed between the tubular member 18 and the outer and inner shells 12, 20 are also angled or oriented diagonally with respect to the vertical axis A of heat exchanger 10. Accordingly, the fluid or gas flowing through the axially extending passageways formed by the ribs 36, 40 and tough regions 38, 42 on the tubular member 18 and the outer and inner shells 12, 20 of the heat exchanger 10 tends to spiral axially around the tubular member 18 in annular space 25.

When the heat exchanger 10 is incorporated into a Stirling engine, its hollow centre may be substantially completely filled by another cylindrical structure such as a housing which may encase one or more other components of a Stirling engine. The housing is a stationary component which may form a close fit with the inner shell 20 of heat exchanger 10 (or with the tubular member 18 in embodiments that do not incorporate in inner shell 20) and is either in very close proximity to and/or in contact with the inner surface 24 of the inner shell 20 along its circumference. As is understood in the art, a Stirling engine generally operates by means of the compression and expansion of a working fluid, i.e. a gas, at different temperatures levels to convert heat energy to mechanical work. During operation, a fixed quantity of permanently gaseous working fluid, such as air or helium, is put through a cycle of (i) compressing cool gas, (ii) heating the gas, (iii) expanding the hot gas, and finally (iv) cooling the gas before the cycle is repeated. When incorporated into a Stirling engine, heat exchanger 10 serves to cool the gaseous working fluid and must be able to withstand the pressure exerted by the working fluid, which may be at a pressure of from about 40-60 bar. For this reason, the outer shell 12 may be quite thick.

In operation, liquid coolant or a first fluid enters the heat exchanger 10 through inlet opening 56 and enters tubular member 18. The first fluid then flows circumferentially and axially through the first fluid passageway in tubular member 18 to outlet opening 58 through which it exits the heat exchanger 10. Since the inlet and outlet openings 56, 58 are essentially circumferentially aligned with each other (see FIG. 7) as a result of the angled ends 30 of tubular member 18, the liquid coolant or first fluid travels the entire length or circumference of the tubular member 18 thereby minimizing the amount of "dead space" in tubular member 18 and ensuring optimal distribution of the coolant or first fluid through the heat exchanger 10. This helps to ensure very even cooling through the heat exchanger 10. As the liquid coolant or first fluid flows circumferentially through tubular member 18, the second fluid (for example, air or helium) flows axially (either upwardly or downwardly) through the axially extending passageways formed on either side of the tubular member 18 in annular space 25. As the axially extending passageways formed between the tubular member 18 and the inner surface 16 of the outer shell 12 are oriented in the same direction (i.e. the first direction) as the ribs 36 and trough regions 38 on the first plate 26, while the axially extending passageways formed between the tubular member 18 and the outer surface of the inner shell 20 are oriented in the same direction (i.e. the second direction) as the ribs 40 and trough regions 42 on the second plate 28, the second direction being opposite to the first direction, the second fluid flowing in the axially extending passageways spirals in the first direction between tubular member 18 and the outer shell 12 and spirals in the opposite, second direction between tubular member 18 and the inner shell 20.

While the example embodiment has been described as including an inner shell 20, as mentioned above, it will be understood that the heat exchanger 10 may also be formed without an inner shell 20. In cases where the inner shell 20 is provided and the heat exchanger 10 is incorporated into a Stirling engine, the inner shell 20 may assist in achieving desired spacing tolerances between the heat exchanger 10 and the housing of the Stirling engine components positioned within the open, hollow centre 19. The inner shell 20 may also assist in achieving proper sealing of gaps between the heat exchanger 10 and the housing or additional components placed within its hollow centre 19. However, it will be understood that heat exchanger 10 can operate within a Stirling engine without inner shell 20.

As well, while the example embodiments discussed above have been described in connection with a tubular member 18 formed by mating first and second plates 26, 28 wherein both plates 26, 28 are formed with ribs 36, 40, it will be understood that only the first plate 26 may be formed with ribs while the second plate 28 may be formed with a planar central portion 32 (see FIG. 10) that is free of ribs or other embossments. In this example embodiment, a turbulizer or other heat transfer augmentation device (not shown) may be provided in flow passage 44 formed between the plates 26, 28. Furthermore, it will be understood that embossments other than ribs, such as dimples, may be formed in the central portion 32 of the first plate 26 or both the first and second plates 26, 28.

Figure 9:
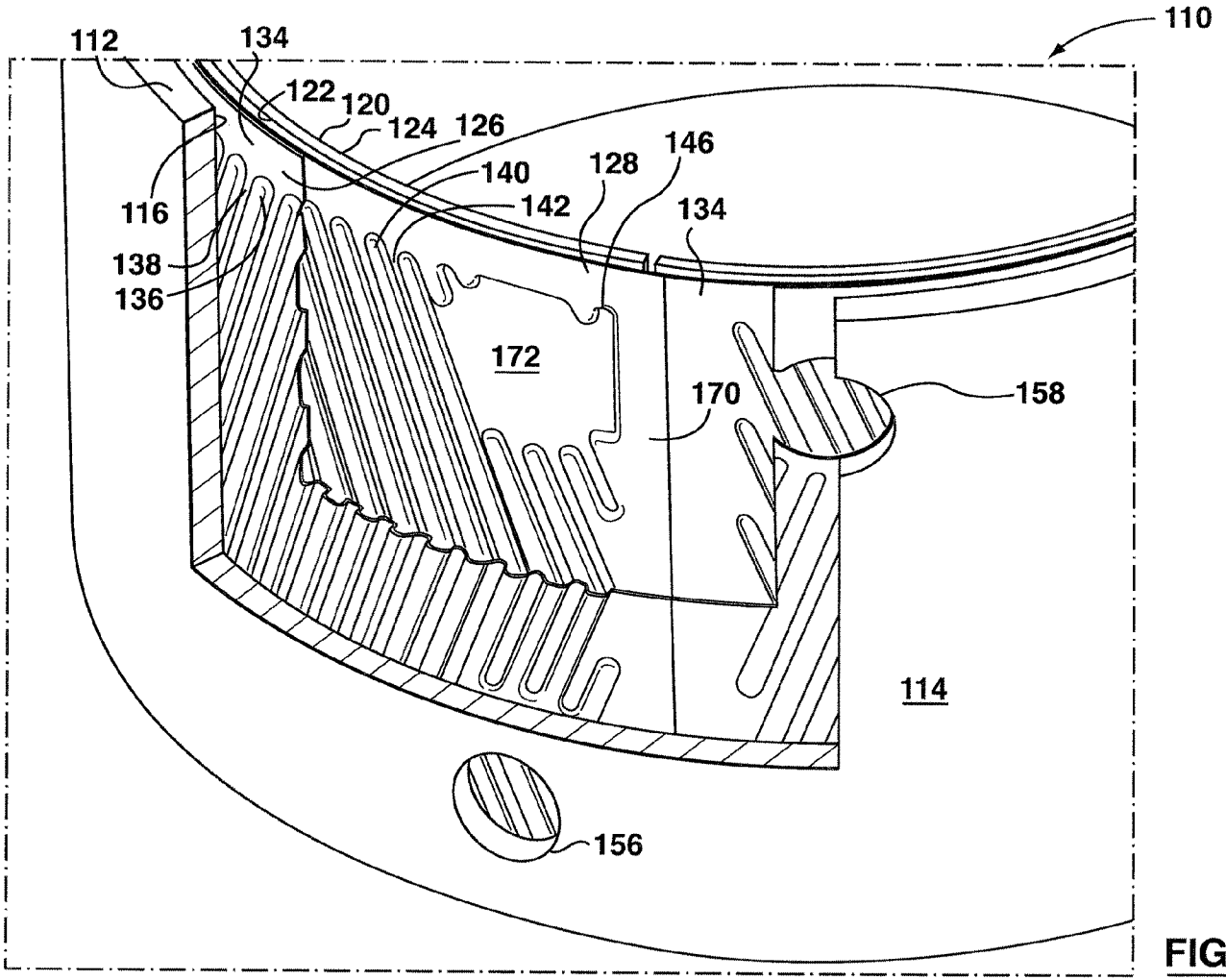
FIG. 9 is a detail view of a cut-away portion of a heat exchanger according to another example embodiment of the present disclosure.

Referring now to FIG. 9, there is shown another example embodiment of a heat exchanger 110 according to the present disclosure wherein similar reference numerals, increased by a factor of 100, have been used to identify similar features. In this example embodiment, tubular member 118 is comprised of first and second plates 126, 128 similar in structure to first and second plates 26, 28; however, in this example embodiment first and second plates 126, 128 are formed with straight, vertical ends 130. First plate 126 has one boss 146 located in the upper corner of one of the ends 130 of the plate 126 while the other boss 146 is located in lower corner of the other end 130 of the plate 126. Each boss 146 has an opening formed therein, the openings acting as respective inlet and outlet openings 148, 150 for tubular member 118. While inlet opening 148 is shown as being located in a lower corner of the first plate 126 with the outlet opening 150 being located in the opposite upper corner of the first plate, it will be understood that the inlet and outlet openings 148, 150 could be reversed. When the first and second plates 126, 128 are bent into their cylindrical form to form tubular member 118, the inlet and outlet openings 148, 150 are not vertically aligned with each other, as in the case of the previous example embodiment, but rather the inlet and outlet openings 148, 150 are circumferentially spaced apart from each other by a flat or planar region 170, through which no fluid flows, the planar region 170 corresponding to the width of the peripheral flange 134 in the end region of each of the plates 126, 128. The planar region 170 helps to ensure that no bypass flow occurs between the inlet and outlet openings 148, 150. Accordingly, all fluid entering the tubular member 118 flows the entire circumferential length of the fluid passageway formed between first and second plates 126, 128. However, as there is no fluid flow in the flat or planar region 170, the distribution of the first fluid through tubular member 118 or heat exchanger 110 is not as even as in the previously described example embodiment. Accordingly, heat exchanger 110 may be better suited for applications where extremely uniform fluid flow and even cooling throughout the heat exchanger is not as essential.

Referring again to FIG. 9, it is shown that second plate 128 includes a region 172 that does not include ribs 140. This is due to the fact that, in this example embodiment, second plate 128 is identical in structure to first plate 126, with the second plate 128 simply being inverted with respect to the first plate 126. Identical first and second plates 126, 128 are used to facilitate manufacturing since only one type of plate needs to be formed. The only difference between the first and second plates 126, 128 is that the second plate 128 does not include inlet and outlet openings; therefore, the bosses 146 remain as plane surfaces identified as regions 172 (only one of which is shown). Regions 172, therefore, provide additional contact between the second plate 128 and the inner shell 20 which may further increase the strength of the connection between the components of the heat exchanger 110. It will be understood, however, that rather than using identical first and second plates 126, 128, the second plate 128 could also be formed as separate plate wherein the central portion 132 is entirely embossed with ribs 140 as described in connection with the example embodiment shown in FIGS. 1-8.

The components making up the heat exchanger according to the present disclosure may be made from a variety of materials which are preferably selected so as to maximize heat transfer, strength and durability. For example, the components of the heat exchanger can be formed from the same or different metals such as aluminium, nickel, copper, titanium, alloys thereof, and steel or stainless steel.

Furthermore, while the present disclosure has been described with reference to certain example embodiments, it is not intended to be limited or restricted thereto. Rather, it will be understood by persons skilled in the art that the present disclosure includes within its scope all variations, modifications and/or example embodiments which may fall within the scope of the following claims.

What is claimed is:

1. A heat exchanger comprising:

an outer shell having an outer surface and an inner surface, the outer shell defining a generally cylindrical wall extending along an axis between a first and second end;

a tubular member positioned adjacent to the inner surface of the outer shell so as to form an annular gap therebetween, the tubular member having at least a portion in contact with the inner surface of the outer shell so as to provide a first set of one or more axially-extending spaces in the annular gap provided between the inner surface of the outer shell and the tubular member, the tubular member extending along said axis between opposed axial ends and having a first circumferential end and a second circumferential end, the first circumferential end abutting said second circumferential end so as to define an annular, tubular form, the tubular member following the circumference of the inner surface of said outer shell, and defining an open, interior space;

the tubular member having first and second spaced apart walls defining a first flow passage therebetween for the flow of a first fluid through said heat exchanger, the first flow passage extending from said first circumferential end to said second circumferential end and defining a maximum circumferential length generally corresponding to the distance between the first circumferential end and the second circumferential end of said tubular member;

an inlet opening extending through the outer shell and the first sidewall of said tubular member proximal to said first circumferential end of said tubular member, the inlet opening being in fluid communication with said first flow passage for delivering said first fluid to said first flow passage;

an outlet opening extending through the outer shell and the first sidewall of the tubular member proximal to said second circumferential end, the outlet opening being in fluid communication with the first flow passage for discharging said first fluid from said first flow passage;

a second fluid flow passage comprising at least the first set of one or more axially-extending spaces formed between the inner surface of said outer shell and the tubular member, the second fluid flow passage having open, axially spaced ends for the flow of a second fluid through said heat exchanger;

wherein said inlet opening and said outlet opening are arranged at respective opposed axial ends of said tubular member, the first flow passage having both circumferential and axial flow directions so that fluid entering through the inlet opening in said first circumferential end of the tubular member at one axial end thereof flows the maximum circumferential length and axial length of the tubular member before exiting the heat exchanger through the outlet opening at said second circumferential end of the tubular member at the opposed axial end thereof; and wherein said first and second circumferential ends of said tubular member are in the form of corresponding angled ends, each angled end defining an acute, outermost corner, the inlet and outlet openings being formed, respectively, in the acute, outermost corner of the corresponding angled end.

2. The heat exchanger as claimed in claim 1, wherein the first sidewall of the tubular member comprises a series of outwardly protruding ribs forming said first set of axially-extending spaces between the first sidewall of the tubular member and the inner surface of the outer shell defining said second flow passage.

3. The heat exchanger as claimed in claim 1, wherein a boss is formed in respective ends of the first sidewall of the tubular member, the inlet opening and the outlet opening extending through the respective boss, each boss having a sealing surface surrounding the respective inlet or outlet opening, the sealing surface contacting and sealing against the inner surface of the outer shell.

4. The heat exchanger as claimed in claim 1, wherein the inlet and outlet openings in said tubular member are substantially aligned in the axial direction when said angled ends are arranged in their abutting, juxtaposed relationship.

5. The heat exchanger as claimed in claim 1, further including an inner shell having an outer surface and an inner surface, the inner shell defining a generally cylindrical wall extending along said axis between a first and second end, the inner shell being positioned adjacent to and in contact with the second sidewall of the tubular member so as to provide a second set of one or more axially-extending spaces therebetween, the inner shell following the inner circumference of the tubular member and maintaining said open, interior space.

6. The heat exchanger as claimed in claim 5, wherein the second sidewall of the tubular member comprises a series of ribs, said ribs forming said second set of axially-extending spaces between the second sidewall of the tubular member and the outer surface of the inner shell, said second set of axially extending spaces forming part of said second flow passage.

7. The heat exchanger as claimed in claim 6, wherein the second fluid flowing through the heat exchanger is split between the first set of axially extending spaces formed between the outer shell and the tubular member and the second set of axially extending spaces formed between the inner shell and the tubular member.

8. The heat exchanger as claimed in 7, wherein said first set of axially extending spaces are oriented in a first diagonal direction and wherein said second set of axially extending spaces are oriented in a second diagonal direction generally opposite to said first diagonal direction.

9. The heat exchanger as claimed in claim 1, wherein the first and second circumferential ends are formed with corresponding tabs and recesses to ensure proper alignment of the first and second circumferential ends when said ends are arranged in juxtaposition forming said tubular member.

10. The heat exchanger as claimed in claim 1, wherein the tubular member is comprised of first and second mating, elongate plates having opposed ends, the first and second plates each comprising a central portion surrounded by a peripheral flange for sealingly joining to the corresponding peripheral flange on the mating first or second plate, the first and second plates defining said first and second spaced-apart sidewalls of said first flow passage, the opposed ends of the first and second plates forming the first and second circumferential ends of the tubular member.

11. The heat exchanger as claimed in claim 10, wherein the central portions of the first and second plates are embossed with ribs, the ribs being spaced-apart by corresponding trough regions, the ribs on the first plate being oriented in a first, diagonal direction and the ribs on the second plate being oriented in a second, diagonal direction, opposite to said first direction, the ribs on the first plate contacting the inner surface of the outer shell so as to define the first set of axially extending spaces therebetween, the corresponding trough regions on the first and second plates contacting each other when said plates are arranged in their facing relation defining said first flow passage, the first flow passage thereby forming a tortuous fluid path through the tubular member.

12. The heat exchanger as claimed in claim 11, wherein a boss is formed in respective ends of the first plate, the inlet opening and the outlet opening extending through the respective boss, each boss having a sealing surface surrounding the respective inlet or outlet opening, the sealing surface contacting and sealing against the inner surface of the outer shell.

13. The heat exchanger as claimed in claim 12, wherein said opposed ends of said first and second plates are angled, the angled ends of said first plate corresponding to and mating with the angled ends of said second plate, the corresponding angled ends of said first and second plates forming the angled first and second circumferential ends of said tubular member.

14. The heat exchanger as claimed in claim 13, wherein the inlet and outlet openings in said first plate are substantially aligned in the axial direction when said angled ends of said tubular member are positioned in their abutting, juxtaposed relationship.

15. The heat exchanger as claimed in claim 11, further including an inner shell having an outer surface and an inner surface, the inner shell defining a generally cylindrical wall extending along said axis between a first and second end, the inner shell being positioned adjacent to and in contact with the second plate of the tubular member so as to provide a second set of one or more axially-extending spaces therebetween, the inner shell following the inner circumference of the tubular member and maintaining said open, interior space.

16. The heat exchanger as claimed in claim 15, wherein the second set of one or more axially-extending spaces is formed by the ribs on the second plate of the tubular member and the outer surface of the inner shell, said second set of one or more axially extending spaces forming part of said second flow passage.

17. The heat exchanger as claimed in claim 12, wherein the angled ends of the first and second plates are formed with corresponding tabs and recesses to ensure proper alignment of the first and second circumferential ends of the tubular member when said first and second plates are formed into their generally cylindrical tubular form.

18. The heat exchanger as claimed in claim 1, wherein the outer shell has a thickness to contain an inner gas pressure of at least about 4 bar.

19. The heat exchanger as claimed in claim 1, wherein the first fluid is a liquid coolant and the second fluid is a gas.

20. The heat exchanger as claimed in claim 1, wherein the heat exchanger is incorporated in a Stirling engine, components of the Stirling engine being received in said open, interior space.

21. A heat exchanger comprising:

an outer shell having an outer surface and an inner surface, the outer shell defining a generally cylindrical wall extending along an axis between a first and second end, a tubular member positioned adjacent to the inner surface of the outer shell so as to form an annular gap therebtween, the tubular member having at least a portion in contact with the inner surface of the outer shell so as to provide a first set of one or more axially-extending spaces in the annular gap provided between the inner surface of the outer shell and the tubular member, the tubular member extending along said axis between opposed axial ends and having a first circumferential end and a second circumferential end, the first circumferential end abutting said second circumferential end so as to define an annular, tubular form, the tubular member following the circumference of the inner surface of said outer shell, and defining an open, interior space;

the tubular member having first and second spaced apart walls defining a first flow passage therebetween for the flow of a first fluid through said heat exchanger, the first flow passage extending from said first circumferential end to said second circumferential end and defining a maximum circumferential length generally corresponding to the distance between the first circumferential end and the second circumferential end of said tubular member;

an inlet opening extending through the outer shell and the first sidewall of said tubular member proximal to said first circumferential end of said tubular member, the inlet opening being in fluid communication with said first flow passage for delivering said first fluid to said first flow passage;

an outlet opening extending through the outer shell and the first sidewall of the tubular member proximal to said second circumferential end, the outlet opening being in fluid communication with the first flow passage for discharging said first fluid from said first flow passage;

a second fluid flow passage comprising at least the first set of one or more axially-extending spaces formed between the inner surface of said outer shell and the tubular member, the second fluid flow passage having open, axially spaced ends for the flow of a second fluid through said heat exchanger;

wherein said inlet opening and said outlet opening are arranged at respective opposed axial ends of said tubular member, the first flow passage having both circumferential and axial flow directions so that fluid entering through the inlet opening in said first circumferential end of the tubular member at one axial end thereof flows the maximum circumferential length and axial length of the tubular member before exiting the heat exchanger through the outlet opening at said second circumferential end of the tubular member at the opposed axial end thereof; and wherein the inlet and outlet openings in said tubular member are substantially aligned in the axial direction when said first and second circumferential ends are arranged in their abutting, juxtaposed relationship;

wherein said first and second circumferential ends of said tubular member are in the form of corresponding angled ends, each angled end defining an acute, outermost corner.

* * * * *